US011141338B2

(12) United States Patent
Davis et al.

(10) Patent No.: US 11,141,338 B2
(45) Date of Patent: Oct. 12, 2021

(54) LIGHTWEIGHT CASKET ASSEMBLY WITH SIDE PANEL RAILS

(71) Applicant: Vandor Corporation, Richmond, IN (US)

(72) Inventors: Gerald H. Davis, Fountain City, IN (US); Justin F. Davis, Richmond, IN (US); Gary L. Cox, Richmond, IN (US); Arie K. Elder, Richmond, IN (US); Chad L. Eversole, Richmond, IN (US); Corina A. Hahn, Richmond, IN (US)

(73) Assignee: Vandor Group, Inc., Richmond, IN (US)

( * ) Notice: Subject to any disclaimer, the term of this patent is extended or adjusted under 35 U.S.C. 154(b) by 0 days.

(21) Appl. No.: 16/708,343

(22) Filed: Dec. 9, 2019

(65) Prior Publication Data

US 2020/0113765 A1 Apr. 16, 2020

Related U.S. Application Data

(63) Continuation of application No. 15/473,527, filed on Mar. 29, 2017, now Pat. No. 10,500,117.

(60) Provisional application No. 62/314,668, filed on Mar. 29, 2016.

(51) Int. Cl.

| | |
|---|---|
| ***A61G 17/00*** | (2006.01) |
| ***A61G 17/04*** | (2006.01) |
| ***A61G 17/007*** | (2006.01) |
| ***A61G 17/02*** | (2006.01) |

(52) U.S. Cl.

CPC ..... *A61G 17/004* (2016.11); *A61G 17/0073* (2013.01); *A61G 17/034* (2017.05); *A61G 17/042* (2016.11); *A61G 17/044* (2016.11); *A61G 17/047* (2016.11); *A61G 2203/76* (2013.01)

(58) Field of Classification Search

CPC ..... A61G 2203/76; B65D 5/445; B65D 5/446
USPC ..... 27/2, 4, 14, 19, 35, 12; 229/199, 199.1
See application file for complete search history.

(56) References Cited

U.S. PATENT DOCUMENTS 3,613,189 A * 10/1971 Kirby ..... A61G 17/04 27/35
3,810,282 A * 5/1974 Doggett ..... A61G 17/048 27/35
4,177,543 A * 12/1979 Angermann ..... A61G 17/00 27/35

(Continued)

*Primary Examiner* — William L Miller
(74) *Attorney, Agent, or Firm* — Maginot, Moore & Beck, LLP

(57) ABSTRACT

A casket assembly includes a base, and first and second fabric sheets. The base includes a bottom panel, first and second side panels, and first and second end panels. The base has a length and a width sized and adapted to receive a deceased. The first fabric sheet is operably coupled to the base such that the first fabric sheet extends along and adjacent to an inside surface of the first side panel and an edge of the first fabric sheet is movable. The first fabric sheet is sized and coupled to substantially cover a width of the bottom panel. The second fabric sheet is operably coupled to the base such that the second fabric sheet extends along and adjacent to an inside surface of the second side panel and an edge of the second fabric sheet is movable. The second fabric sheet is sized to substantially cover the width of the bottom panel.

18 Claims, 11 Drawing Sheets

(56) References Cited

U.S. PATENT DOCUMENTS 4,730,370 A * 3/1988 Elder ..... A61G 17/00 27/4
4,967,455 A * 11/1990 Elder ..... A61G 17/0073 27/4
5,775,061 A * 7/1998 Enneking ..... A61G 17/00 53/445
5,815,898 A * 10/1998 Jenkins ..... A61G 17/004 27/4
6,105,220 A * 8/2000 Belanger ..... A61G 17/0073 27/4
6,145,175 A * 11/2000 Enneking ..... B65D 5/22 27/19
6,317,944 B1 * 11/2001 Beaulieu ..... A61G 17/004 27/4
7,003,855 B2 * 2/2006 Lew ..... A61G 17/0073 27/4
7,204,003 B2 * 4/2007 Davis ..... A61G 17/001 27/2
7,302,743 B2 * 12/2007 Fash ..... A61G 17/001 27/4
7,350,278 B2 * 4/2008 Davis ..... A61G 17/001 27/35
8,127,414 B2 * 3/2012 Rankin ..... A61G 17/04 27/35
8,607,423 B2 * 12/2013 Davis ..... A61G 17/044 27/35
8,914,953 B1 * 12/2014 Thacker ..... A61G 17/02 27/35
9,539,161 B2 * 1/2017 Davis ..... E05D 5/046
9,597,248 B2 * 3/2017 Davis ..... A61G 17/044
9,872,809 B1 * 1/2018 Davis ..... A61G 17/001
2002/0004972 A1 * 1/2002 Michaud ..... A61G 17/004 27/4
2007/0084028 A1 * 4/2007 Cox ..... A61G 17/004 27/4
2010/0218351 A1 * 9/2010 Rankin ..... A61G 17/04 27/17
2011/0107567 A1 * 5/2011 Cox ..... A61G 17/0407 27/4
2012/0084952 A1 * 4/2012 Hobstetter ..... A61G 17/024 27/1
2013/0160258 A1 * 6/2013 Davis ..... A61G 17/004 27/2
2014/0026378 A1 * 1/2014 Gessel ..... B65D 5/64 27/4
2014/0123450 A1 * 5/2014 Jenson ..... A61G 17/00 27/14
2014/0230203 A1 * 8/2014 Cox ..... A61G 17/041 27/4
2016/0235611 A1 * 8/2016 Davis ..... A61G 17/044
2017/0209326 A1 * 7/2017 Davis ..... A61G 17/0073
2020/0146919 A1 * 5/2020 Davis ..... A61G 17/0073
2020/0146920 A1 * 5/2020 Davis ..... A61G 17/001

* cited by examiner

LIGHTWEIGHT CASKET ASSEMBLY WITH SIDE PANEL RAILS

This application is a continuation of U.S. patent application Ser. No. 15/473,527, filed May 29, 2017, which in turn claims the benefit of U.S. Provisional Patent Application Ser. No. 62/314,668, filed Mar. 29, 2016, each of which is incorporated herein by reference.

FIELD OF THE INVENTION

This invention relates generally to caskets, and more particularly, to lightweight caskets.

BACKGROUND

Caskets and cremation containers are constructed from a plurality of materials, including wood, metal, and paper materials, as well as combinations of the foregoing. These caskets and cremation containers vary substantially in price. Because wood and metal-based caskets can be expensive, paper-based cremation containers can provide a viable low cost option when cremation is contemplated. In fact, extremely low costs may be achieved by employing a corrugated paper cremation container, which is a fraction of the cost of hardwood or metal caskets. Even if cost is not a major consideration, corrugated paper caskets are a popular choice for cremation, in part because they are completely consumed during the cremation process.

Many corrugated paper caskets can have ornamentation and other design elements that approximate the look decorative wood or steel caskets. Many people find such paper caskets to be suitable for presentation at a viewing and/or funerary service. These ornately designed paper caskets represent a cost savings over hardwood caskets, and are particularly advantageous in cases in which the casket is to be consumed during the cremation process.

While ornately designed paper caskets are less expensive than hardwood caskets, they still represent a significant cost that may not be practical in some cases. In such cases, a more inexpensive option is a simple rectangular corrugated paper container and associated simple rectangular lid that fits over the container. The deceased fits within the container and then the rectangular lid is fitted over the container to close off the casket. The casket is most suitable for a cremation process.

The need for such inexpensive caskets arises in situations of financial need, and also in disaster areas where many deceased are located in a relatively small area. The paper container has significant advantages over traditional caskets in this environment including the ability to transport significant numbers of the lightweight paper casket and the disposability of such caskets.

While cardboard caskets are typically considered to be an economical approach the storage of the deceased, a significant cost nevertheless arises as a result of shipping costs. Even though the caskets are fairly light, they are more or less as bulky as traditional wood and metal caskets. As a result, funerary and/or cremation establishments pay a shipping premium due to the size of the cremation caskets. One way in which such costs can be reduced is to ship the container unassembled, which requires less space in shipping and storing. In such a case, the funerary or cremation establishment is required to assemble the caskets. Assembly of the caskets can be relatively complicated and time consuming, particularly if performed on an intermittent basis at a retail point of sale. Thus, there is a need for a cremation casket that has reduced shipping costs without requiring complex assembly at the retail point of sale.

Another problem with low-cost cremation containers is providing a flexible and aesthetic presentation of the deceased. Because the relatives and/or acquaintances of the deceased will often view the deceased in the cremation containers, it can be desirable to employ blankets and/or sheets to cover all or part of the deceased for viewing. This adds cost and inconvenience to the funerary establishment that must add these features.

SUMMARY

At least some embodiments of the present invention address the above-stated needs by providing a casket assembly that has a low profile for shipping and convenient and flexible fabric elements.

A first embodiment disclosed herein is a casket assembly that includes a base, and first and second fabric sheets. The base includes a bottom panel, first and second side panels, and first and second end panels. The base has a length and a width sized and adapted to receive a deceased. The first fabric sheet is operably coupled to the base such that the first fabric sheet extends along and adjacent to an inside surface of the first side panel and an edge of the first fabric sheet is movable. The first fabric sheet is sized and coupled to substantially cover a width of the bottom panel. The second fabric sheet is operably coupled to the base such that the second fabric sheet extends along and adjacent to an inside surface of the second side panel and an edge of the second fabric sheet is movable. The second fabric sheet is sized to substantially cover the width of the bottom panel.

The above-described features and advantages, as well as others, will become more readily apparent to those of ordinary skill in the art by reference to the following detailed description and accompanying drawings.

DETAILED DESCRIPTION

Figure 1:
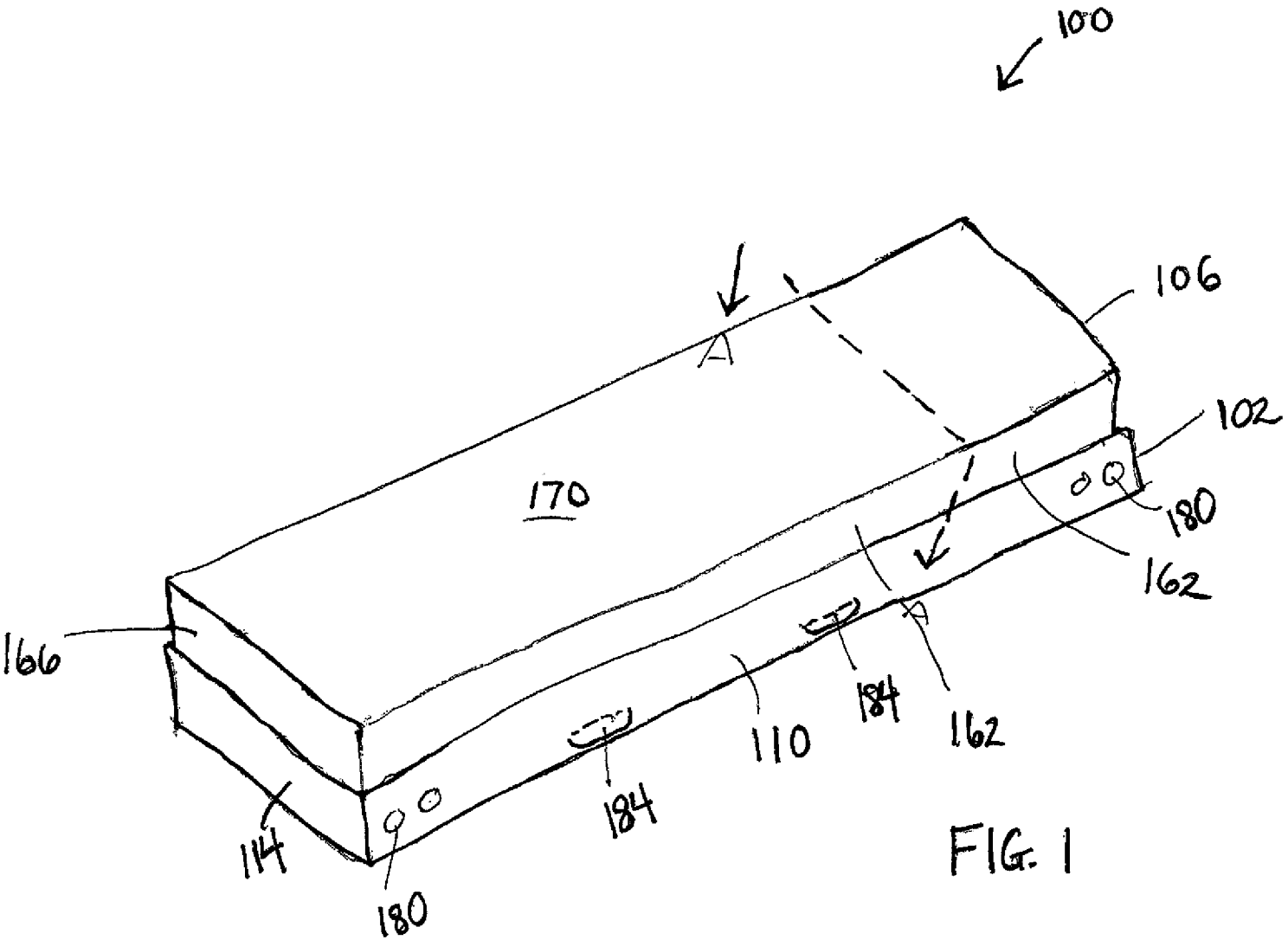
FIG. 1 shows a perspective view of an exemplary embodiment of a casket assembly incorporating principles of the present invention, wherein the casket assembly is closed.
Figure 2:
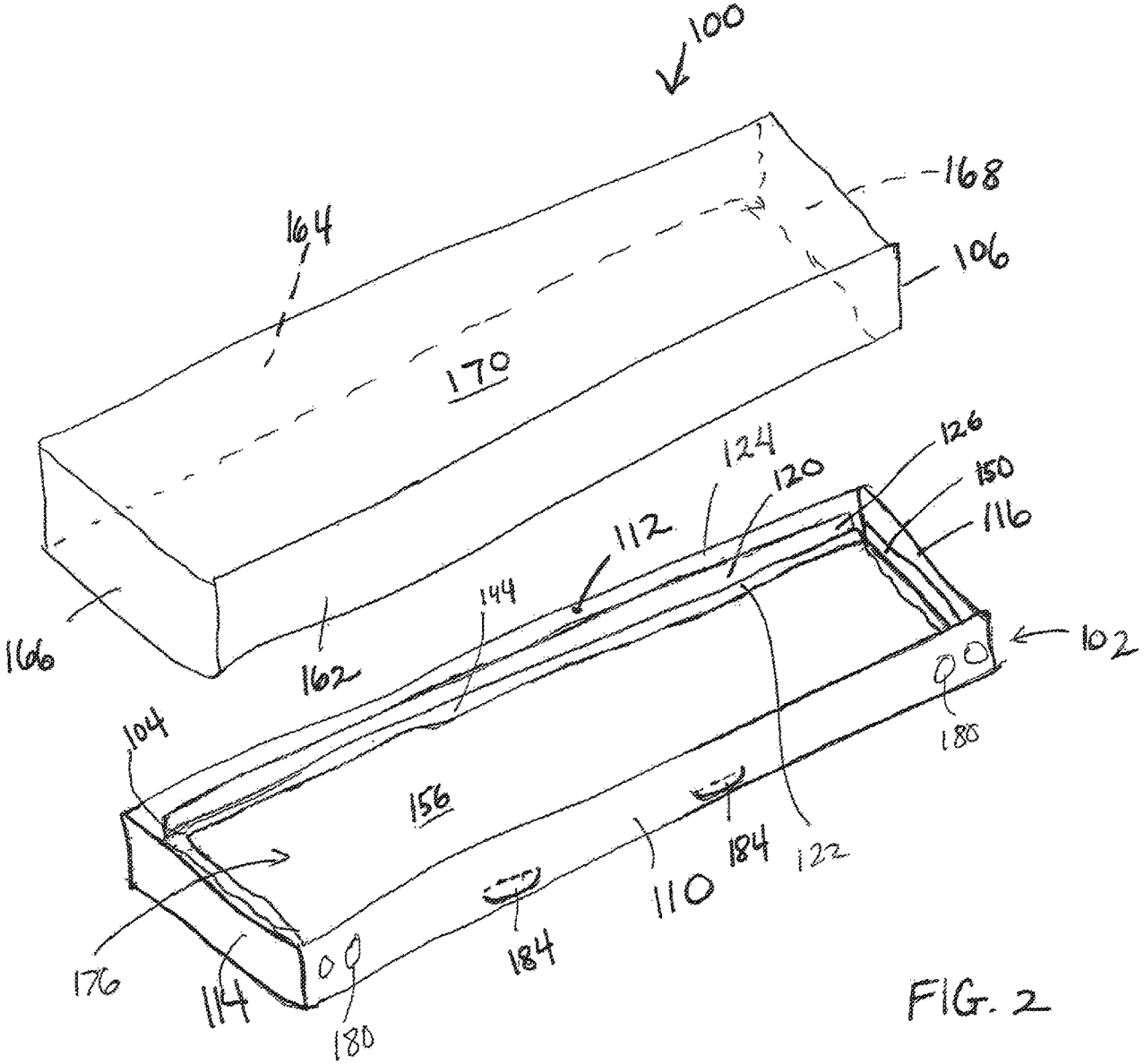
FIG. 2 shows a perspective view of an exemplary embodiment of the casket assembly of FIG. 1, wherein the casket assembly is open.
Figure 3:
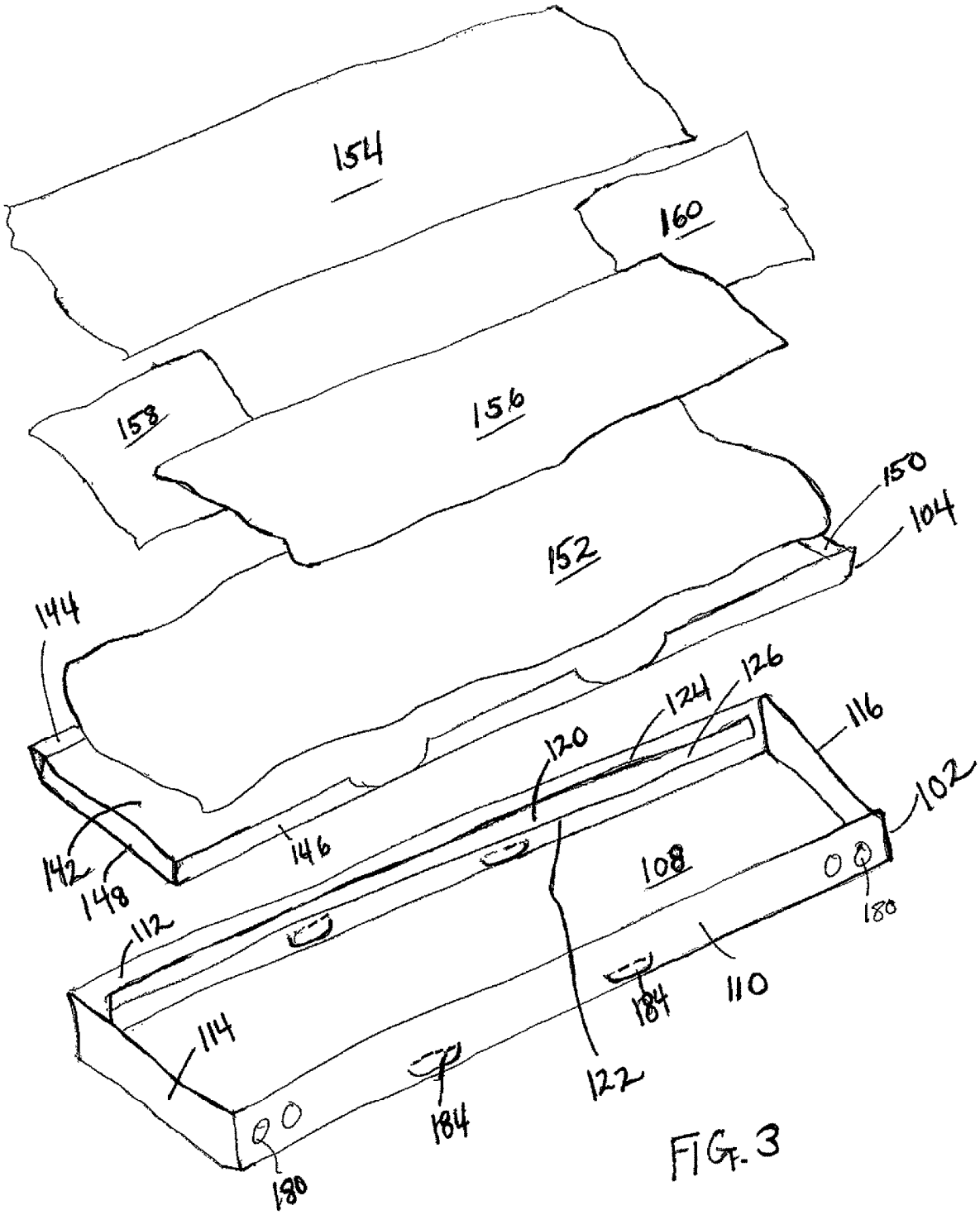
FIG. 3 shows an exploded perspective view of the casket assembly of FIG. 1 apart from the lid.

FIGS. 1, 2 and 3 show perspective views of an exemplary embodiment of a casket assembly 100 incorporating principles of the present invention. FIG. 1 shows the casket assembly 100 in a closed configuration, which may suitably contain and reasonably fit a human deceased lain horizontally to rest in supine position. FIG. 2 shows the casket assembly 100 in an open configuration. FIG. 3 shows an exploded perspective view of the casket assembly 100 apart from the lid 106. The casket assembly 100 includes a base 102, a tray 104, the lid 106, a liquid retaining liner 152, two long fabric sheets 154, 156, and two short fabric sheets 158, 160. In an embodiment discussed further below, the casket assembly 100 also includes fabric throws.

With reference to FIGS. 1, 2 and 3 simultaneously, the base 102 is a structure that includes a bottom panel 108, first and second side panels 110, 112, and first and second end panels 114, 116. The bottom panel 108, the side panels 110, 112, and the end panels 114, 116 are configured as an open-top casket container formed of corrugated paper. Preferably, the bottom panel 108, the two side panels 110, 112, and the two end panels 114, 116 are formed from a single corrugated paper blank. As used herein, the terms "side" and "end" are generally used to describe structures or features that are located, respectively, along the length of the base 102 (and on either side of where the deceased would lie), and along the width of the base 102 (above the head and below the feet of the deceased). It will be further appreciated that in alternative embodiments, the side panels 110, 112 may have an angled design formed by one or more panel sections.

The side panels 110, 112 in the embodiment described herein includes hook and loop fasteners 180 that mate with corresponding fasteners on throw sheets or other materials, such as those discussed further below in connection with FIGS. 5-8. The base 102 also includes an elongate rail 120 coupled to and providing reinforcement to the side panel 112. Although not visible in FIGS. 1, 2 and 3, the base 102 includes another elongate rail 130 coupled to and providing reinforcement to the side panel 110.

Figure 4:
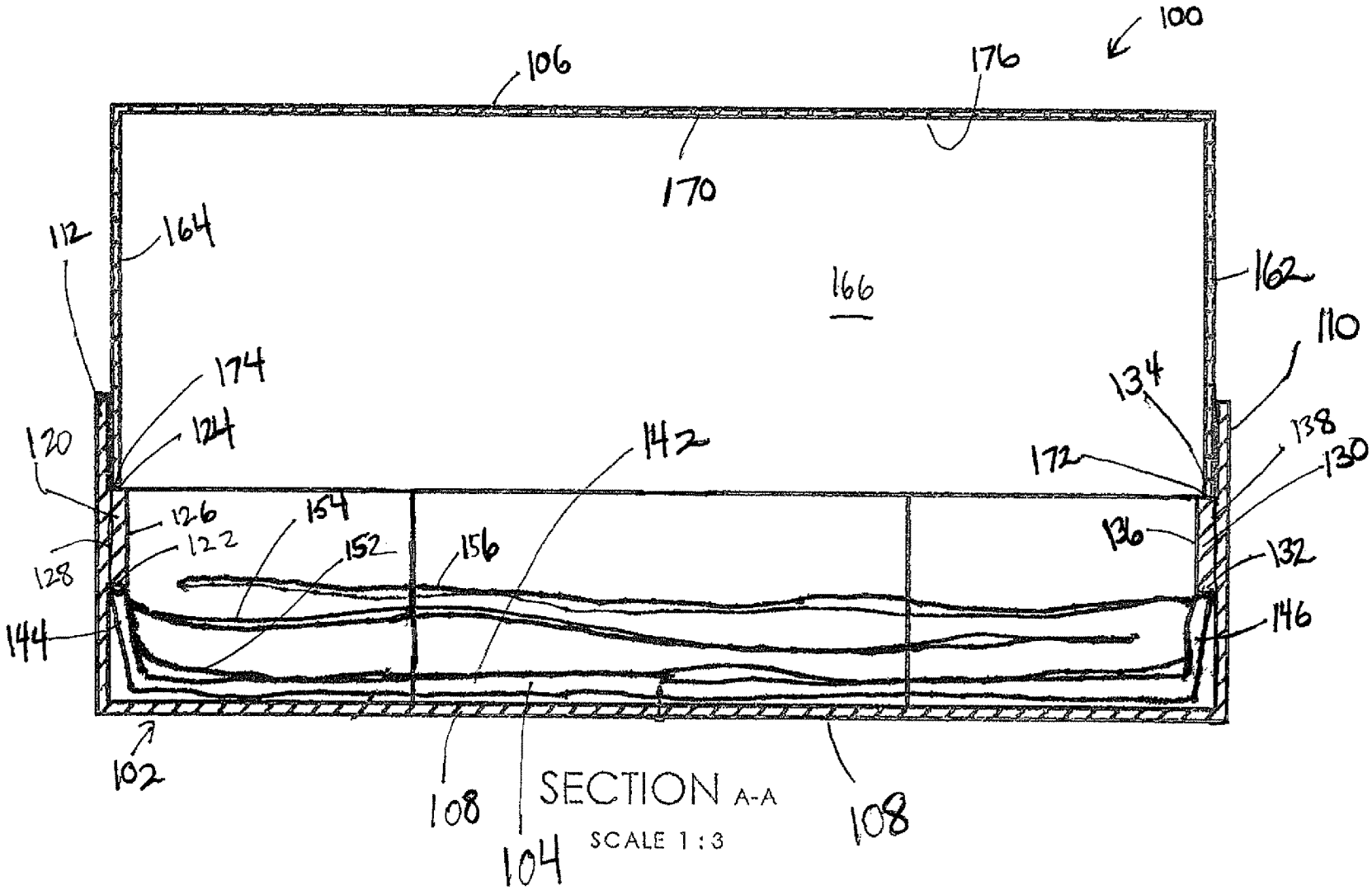
FIG. 4 shows a cutaway view of the casket assembly of FIG. 1 taken along the line A-A of FIG. 1.

In particular, FIG. 4 shows a fragmentary cutaway view taken long the line A-A of FIG. 1. With reference to FIGS. 2, 3 and 4, the rail 120 is formed of a rigid material, such as a wood material, includes a bottom surface 122, a top surface 124, an inner surface 126, and an outer surface 128. The outer surface 128 is adjoined (i.e. coupled directly to) to the side panel 112 to fix the rail 120 on the inner surface of the side panel 112. As can be seen in FIG. 4, the second elongate rail 130 similarly includes a bottom surface 132, a top surface 134, an inner surface 136, and an outer surface 138. The outer surface 138 is adjoined (i.e. coupled directly to) to the side panel 110 to fix the rail 130 on the inner surface of the side panel 110. The rails 120, 130 may suitably be made of wood, plywood, or other engineered wood or wood-type product. The rails 120, 130 are preferably coupled to their corresponding side panels 112, 110 via adhesive or mechanical fasteners.

Referring to FIGS. 2, 3 and 4, the tray 104 includes a tray bottom 142, a first tray side 144, a second tray side 146, a first tray end 148, and a second tray end 150. As shown most clearly in FIG. 4, the first tray side 144 is disposed between the bottom panel 108 of the base 102 and the bottom surface 122 of the first rail 120. Similarly, the second tray side 146 is disposed between the bottom panel 108 of the base 102 and the bottom surface 132 of the rail 130. The liquid retaining liner 152 is disposed at least over the tray bottom 142, and preferably over the inside surface of the tray sides 144, 146. The liquid retaining liner 152 is configured to retain fluid in the casket assembly 100 and avoid leakage of any such fluid. The liquid retaining liner 152 is preferably draped over and fastened or glued to the tray 104.

The tray 104 is snap-fit into the base 102 by wedging the tray sides 144 and 146 under the respective bottom surfaces 122, 132 of the rails 120, 130. To this end, the height of the space between the bottom panel 108 and the bottom surfaces 122, 132 of the rails 120, 130 is equal to or slightly less than the height of the tray sides 144, 146. The tray sides 144, 146 extend in a slightly inclined manner from the bottom panel 108 outward and upward to a position against or adjacent to the respective bottom surfaces 122, 132 of the rails 120, 130. The tray 140 is preferably formed from a corrugated paper blank, not shown, and the tray sides 144, 146 constitute folded-up sides of the corrugated paper blank. Thus, the tray sides 144, 146 have a natural bias towards flattening, or rotating outward. Referring to FIG. 4, it will be appreciated that such a bias urges the tray sides 144, 146 outward toward the respective side panels 112, 110, and into the space under the bottom surfaces 122, 132 of the respective rails 120, 130. This retains the tray 104 in place in the base 102, but also allows it to be removable. Specifically, the tray 104 can be removed by folding in the tray sides 144, 146 against the bias inwardly past the rails 120, 130, and lifting the tray 104 upward. It will be appreciated that the tray bottom 140 preferably has a width that is slightly less than the width defined between the inner surfaces 126, 136 of the rails 120, 130.

The two long fabric sheets 154, 156 and two short fabric sheets 158, 160 collectively form a blanket system that is used for viewing the deceased with the lid 106 removed from the base 102. Each of the long fabric sheets 154, 156 in this embodiment is substantially rectangular in shape, and has a width approximately equal to the width of the casket assembly 100 (or length of the end panels 114, 116), and has a length approximately equal to (but slightly less than) the length of the casket assembly 100 (or the length of the side panels 110, 112). The long fabric sheet 154 is coupled (by glue, staple or other fastener) along one of its long edges to the tray side 144, and the long fabric sheet 156 is similarly coupled along one of its long edges to the tray side 146. In the assembled casket assembly 100, the long sheets 154, 156 almost fully overlap when empty, making available ample fabric for covering for the deceased.

Each of the short fabric sheets 158, 160 in this embodiment is substantially rectangular in shape, and has a width approximately equal to the width of the casket assembly 100 (or length of the end panels 114, 116), and has a length that is substantially shorter than (approximately $\frac{1}{3}^{rd}$ to $\frac{1}{6}^{th}$) the length of the casket assembly 100. The short fabric sheet 158 is coupled along one of its edges to the tray end 148, and the short fabric sheet 160 is coupled along one of its edges to the tray side 150. In the assembled casket assembly 100, the short sheet 158 may be placed under the head of the deceased to provide additional coverage over the liner 152 so that the plastic material is not visible. In the alternative, the short sheet 158 may be placed over the head over the deceased if desirable.

It will be appreciated that the long sheets 154, 156 in this embodiment cannot fully cover the feet. Accordingly, the short sheet 160 provides additional coverage to the feet to ensure coverage.

The lid 106 is also in the form of an open box. The lid 106 is configured and sized to cover an interior 176 of the base 102 when the lid 106 is placed on the base 102 to "close" the casket assembly 100. The lid 106 is also preferably formed of a single corrugated paper blank and includes two opposing lid sides 162, 164, two opposing lid ends 166, 168, and a lid top 170. Each of the lid sides 162, 164 have a length that is slightly less than that of the each of the side panels 110, 112, and each of the two lid ends 166, 168 have a length that it slightly less that of each of the end panels 114, 116. As a consequence, in the closed position, the lid 106 fits within the base 102 and rests on the top surfaces 124, 134 of the respective rails 120, 130. (See FIG. 4). More specifically, bottom edges 172, 174 of the respective lid sides 162, 164 engage the respective top surfaces 134, 124.

Thus, the lid 106 is disposed partly within the base 102, but sits atop the rails 120, 130. This allows the lid 106 to be shallower than the total depth of the interior 176 of the casket assembly 100. Since the depth of the interior 176 is defined by the need to contain a human deceased in supine position, a lid designed to be contained with the casket base typically needed to have a height equal to the height of the interior of the casket. Because the lid 106 of the present embodiment lies on the reinforcement rails 120, 130, it may be shallower, thus reducing material cost and shipping weight. In particular, if the lid 106 had to extend all the way to the bottom panel 108, it would have to be taller, thereby using more material and having additional weight for shipment.

It can be seen that the embodiment described above takes advantage of the reinforcement rails 120, 130 not only to strengthen the side panels 110, 112, but also to trap fit the removable tray 104, and to provide a support for the lid 106.

For viewing purposes, the casket lid 106 is removed. The deceased, not shown, lays supine on the tray 140 over the liner 152. In one common example, the short sheet 158 will be placed under the head of the deceased, not shown, and the short sheet 160 will be place over the feet of deceased. The long sheets 154, 156 will be laid over the body of the deceased such that a desired portion is exposed.

It will be appreciated that in such a condition, the corrugated paper edges of the side panels 110, 112 and end panels 114, 116 are visibly exposed, which can be undesirable. Accordingly, in an embodiment of the invention, the casket assembly 100 further includes a plurality of "throws" that can be draped over the side panels 110, 112 and end panels 114, 116 to cover and hide the edges thereof.

Figure 5:
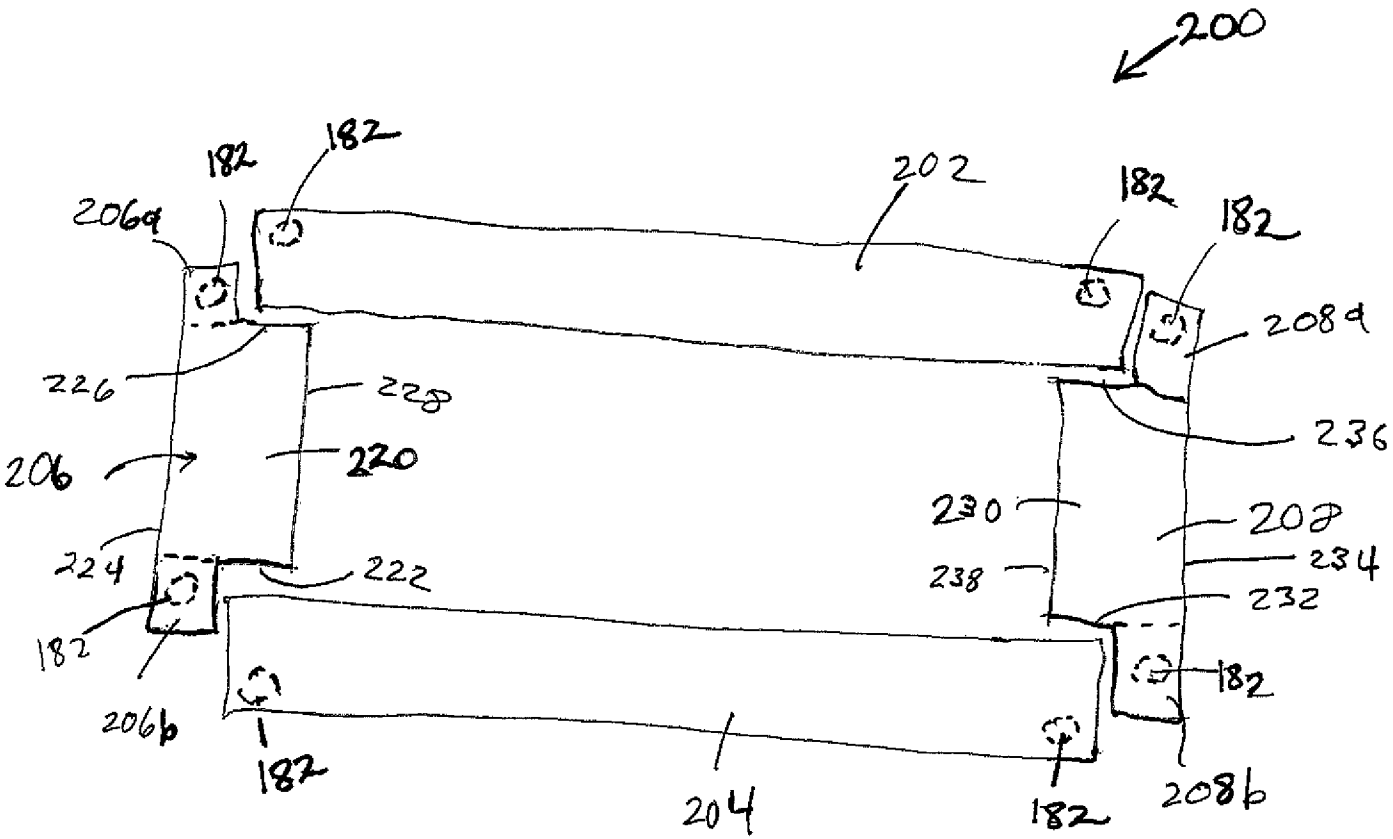
FIG. 5 shows a top plan view of a plurality of throws that may be employed in with the casket assembly.
Figure 6:
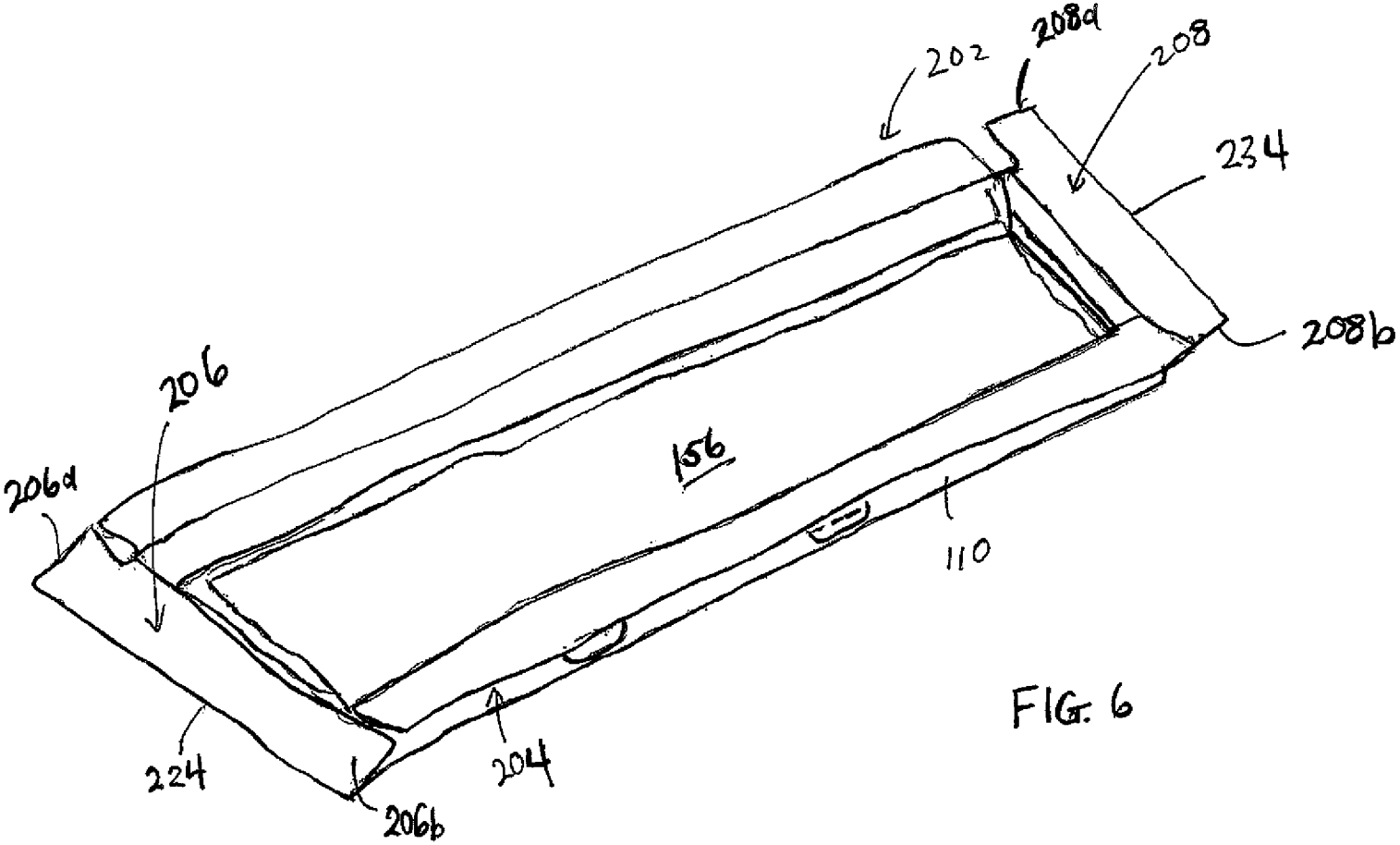
FIG. 6 shows a perspective view of the casket assembly of FIG. 1 apart from the lid, with the throws of FIG. 5 splayed outward, or partially arranged for viewing.
Figure 7:
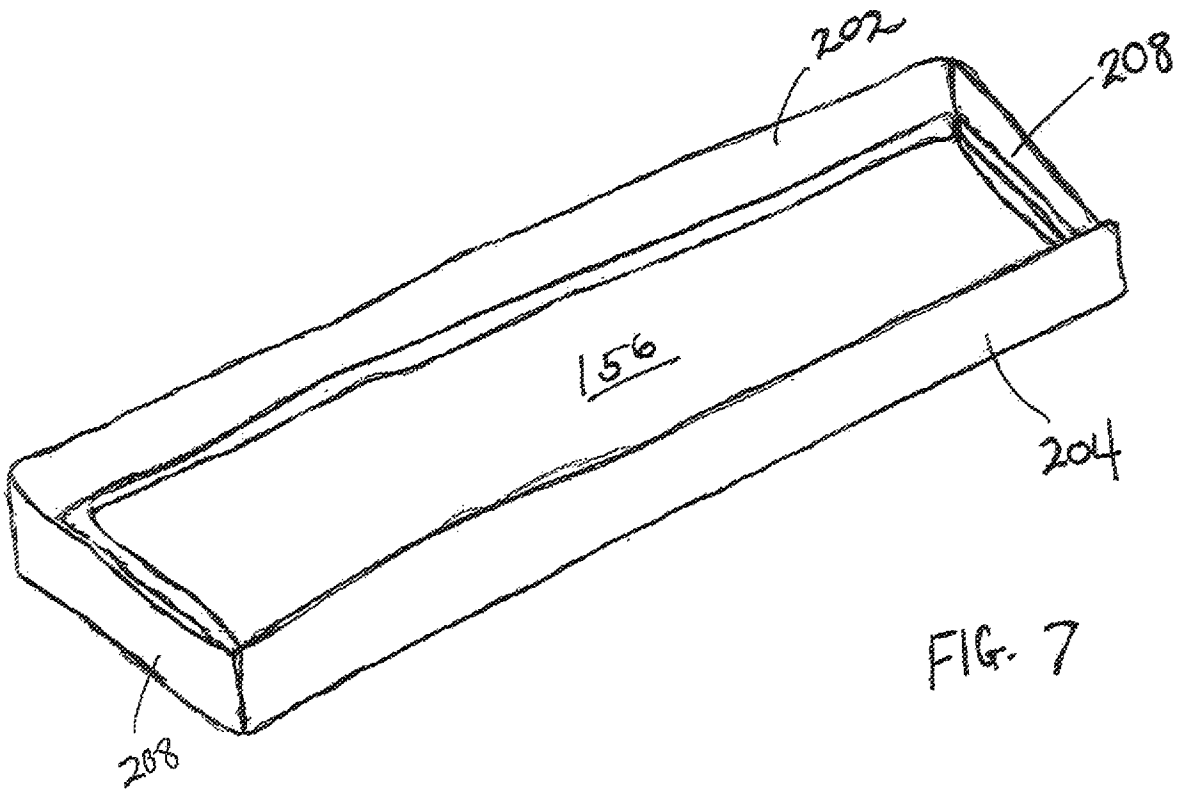
FIG. 7 shows a perspective view of the casket assembly of FIG. 1 apart from the lid with the throws of FIG. 5 configured for viewing or display.
Figure 8:
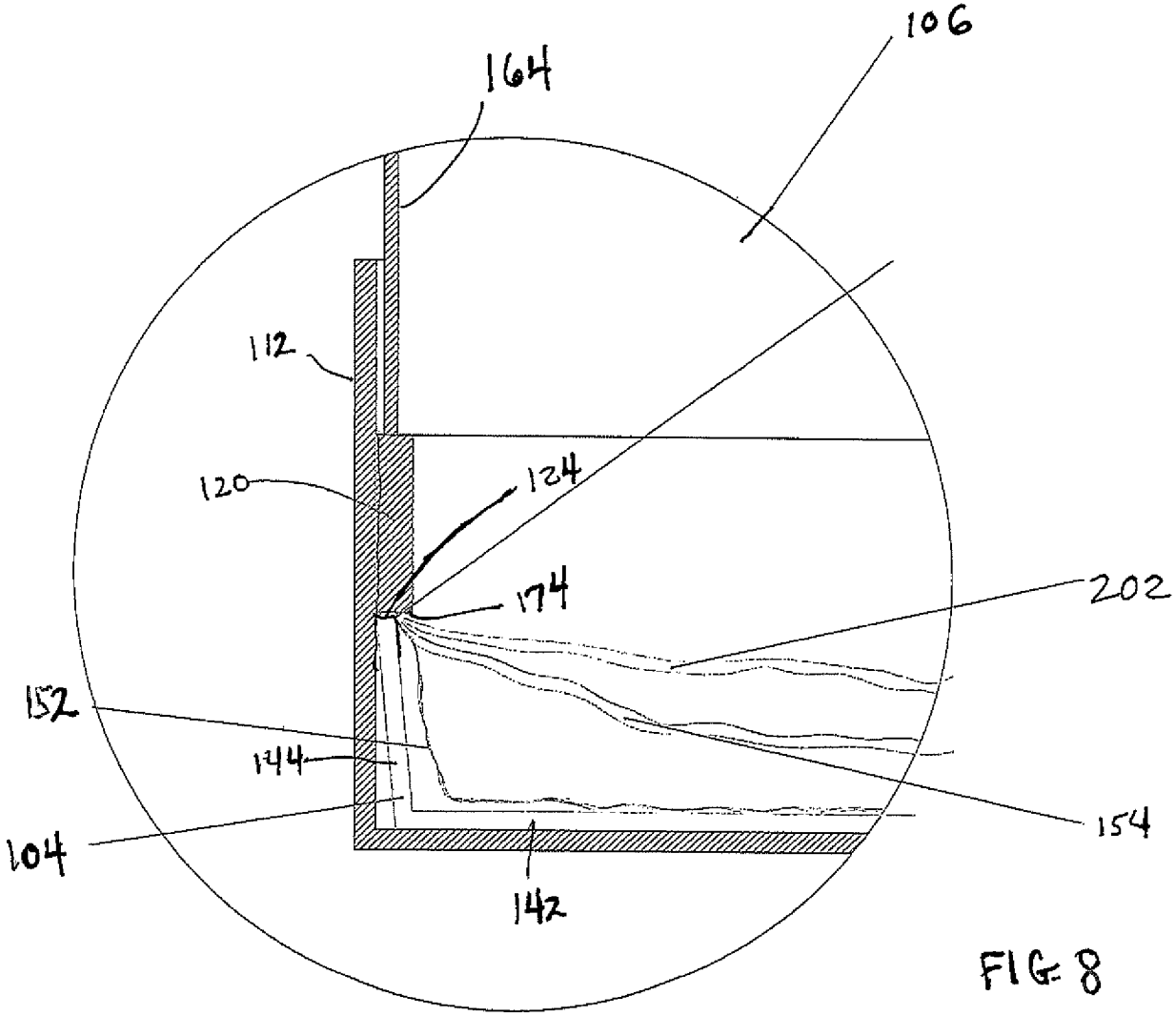
FIG. 8 shows a fragmentary cutaway view of the casket assembly of FIG. 1 with the throw stowed within the interior.

FIG. 5 shows a top plan view of a plurality of throws 200 that may be employed in with the casket assembly 100. In this embodiment, the plurality of throws 200 includes two long throws 202, 204 and two short throws 206, 208. FIG. 5 shows the plurality of throws 202, 204, 206 and 208 apart from the base 102, tray 104 and lid 106 of the casket assembly 100. FIG. 6 shows perspective view of the casket assembly 100 apart from the lid 106 with the throws 200 splayed outward, or partially arranged for viewing. FIG. 7 shows a perspective view of the casket assembly 100 apart from the lid 106 with the throws 200 configured for viewing or display. FIG. 8 shows a fragmentary cutaway view of the casket assembly 100 closed with the throw 202 stowed within the interior 176.

Each of the throws 202, 204, 206 and 208 is a decorative fabric, preferably double ply (such that the throws 202, 204, 206 and 208 shown in FIG. 5 are folded-over pieces of twice their size). However, it will be appreciated that each of the fabric throws 202, 204, 206 and 208 may be a single sheet, particularly if the fabric has more than minimal thickness. In general, the throws 202, 204, 206 and 208 are stowed by laying them within the interior 176 of the casket assembly 100. (See FIG. 8). As will discussed below in further detail, the throws 202, 204, 206 and 208 are arranged for viewing by folding them outward over the edges of the tray 104 and base 102 of the casket assembly 100, as shown in FIG. 7. The throws 200 optionally include hook and loop fasteners 182 configured to removably connect to fasteners 180 on the sides 110, 112 of the casket base 102.

In particular, each of two long throws 202, 204 in this embodiment is substantially rectangular in shape, and has a length approximately equal to the length of the side panels 110, 112). The long throw 202 is permanently affixed along one of its long edges to the tray side 144, and the long throw 204 is permanently affixed along one of its long edges to the tray side 146. (See FIGS. 7, 8, discussed further below). Each of the long throws 202, 204 has a width sufficient to lay up and over the top and at least part of the way down the outside of their respective side panel 112, 110. (See FIGS. 6, 7). FIG. 6 shows a perspective view of the base 102 with the throws 202, 204, 206 and 208 splayed outward. It will be appreciated that the position of the throws 202, 204, 206 and 208 is non-static position shown as a way of illustrating how the throws are draped. In practice, the throws 202, 204, 206 or 208 would have to be manipulated or held in that position. FIG. 7 shows the same perspective view of the base with the throws 202, 204, 206 and 208 fully coupled for viewing. As shown in FIG. 7, the long throws 202, 204 have a width sufficient to at least drape over and cover the top edge of the respective side panels 110, 112.

Referring again to FIG. 5, the short throw 206 in this embodiment has a shape that is essentially rectangular except for wings 206*a*, 206*b* which extend outward from opposing short edges. In particular, the short throw 206 has a rectangular core 220 having nominal edges 222, 224, 226, and 228. The wing 206*a* extends outward from the edge 226 in the corner where the edge 226 intersects with the edge 224. The wing 206*b* similarly extends outward from the edge 222 in the corner where the edge 222 intersects with the edge 224. The wings 206*a*, 206*b* allow for a more continuous fabric appearance at the corners of the base 102 when arranged for display. The edge or side 228 is coupled to the tray end 148. (See FIG. 3).

The short throw 208 in this embodiment has a shape that is essentially identical to that of the short throw 206, and thus includes wings 208*a*, 208*b* which extend outward from opposing short edges. In particular, the short throw 208 has a rectangular core 230 having nominal edges 232, 234, 236, and 238. The wing 208*a* extends outward from the edge 236 in the corner where the edge 236 intersects with the edge 234. The wing 208*b* similarly extends outward from the edge 232 in the corner where the edge 232 intersects with the edge 234. The edge or side 238 is coupled to the tray end 150. (See FIG. 3).

FIG. 8 shows a fragmentary portion of the cutaway A-A of FIG. 1 showing in of a portion of the casket assembly 100 in the embodiment including the throws 202, 204, 206 and 208. FIG. 8 illustrates in further detail how the throw 202, the fabric sheet 154, the tray 104 and the lid 106 are arranged when the casket 100 is closed. As discussed above in connection with FIG. 4, the lid 106 rests on the rails 120 and 130. In the embodiment of FIGS. 5-8, which is identical to the embodiment of FIGS. 1-4 except for the addition of the throws 200, the edge 174 of lid side 164 rests on the top surface 124 of the side rail 120.

As discussed further above, the liner 152 is coupled to the tray 140 such that it completely or nearly completely covers the tray bottom 142, the tray sides 144, 146 and the tray ends 148, 150. (See also FIGS. 2 and 3). With specific reference to FIG. 8, the fabric sheet 154 is then stapled or otherwise fastened along its long edge to the tray side 144. The long throw 202 is similar fastened long its long edge to the tray side 144. Although now shown in FIG. 8, the fabric sheet 156 and the throw 204 are fastened in a similar manner along their long edges to the tray side 146. The fabric sheet 158 and side 228 of the throw 206 are likewise fastened to the tray end 148, and the fabric sheet 160 and side 238 of the throw 208 are likewise fastened to the tray end 150.

In use, the casket assembly 100 may be shipped in a partially unassembled state. Specifically, the lid 106 may be collapsed into a flat structure, with the lid sides 162, 164 and the lid ends 166, 168 folded down over the lid top 170. Methods of easily collapsing and assembling simple rectangular box lids are well known. It will be appreciated that the assembly at the funeral establishment or other commercial destination may employ additional fasteners, such as staples and/or adhesive, in some embodiments, or tab and slot connections other embodiments.

Figure 9:
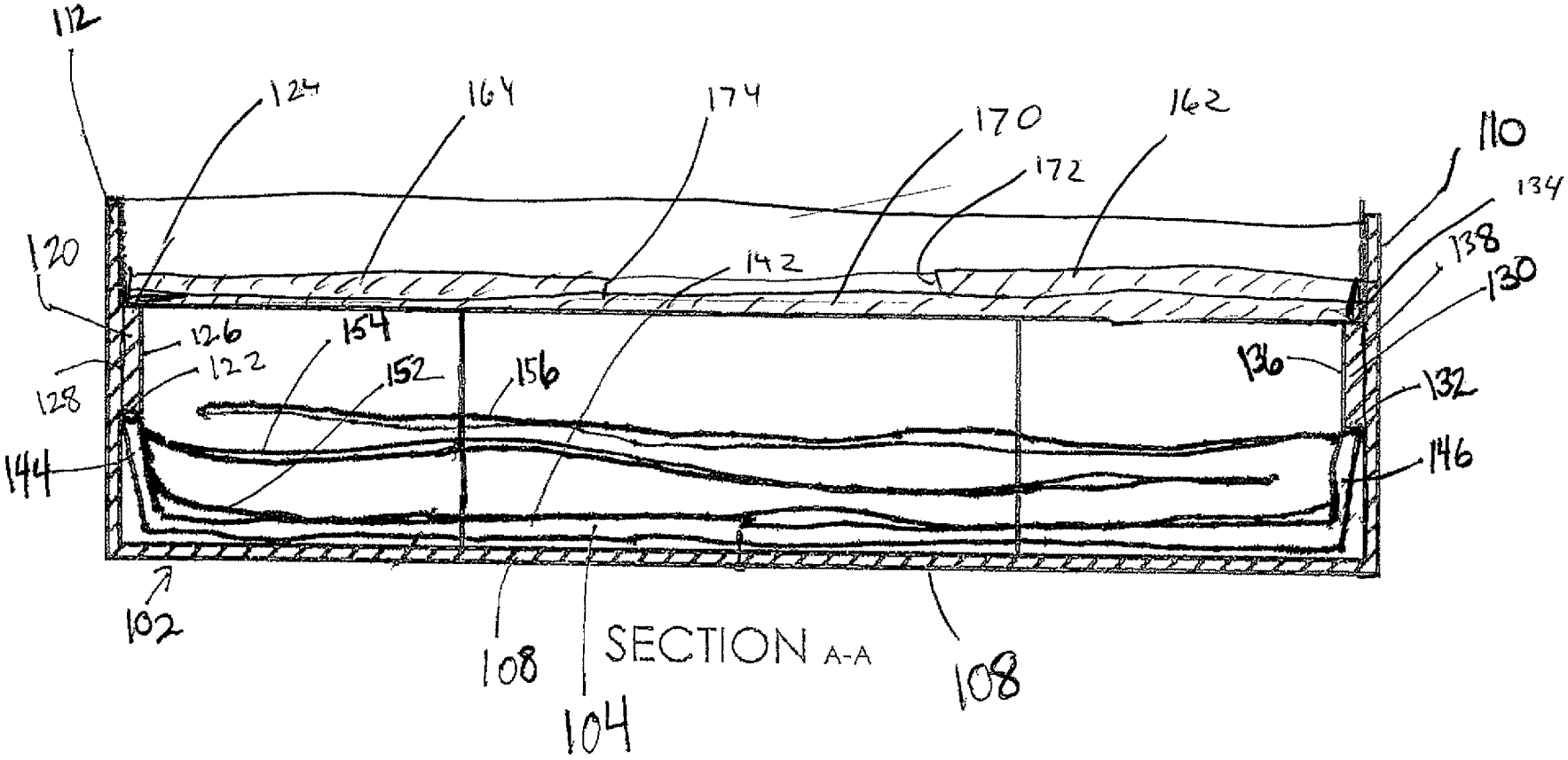
FIG. 9 shows a cutaway view similar to FIG. 4, but with the top collapsed and inserted into the base of the casket assembly of FIG. 1 for shipping.

FIG. 9 shows the same section A-A of FIG. 1 of the casket assembly as shown in FIG. 4, but with the lid 106 collapsed and inserted into the base 102 for shipment. As shown in FIG. 9, the lid sides 162, 164 are folded inward onto the lid top 170. In one embodiment, the lid 106 is placed on the top surfaces 124, 134 of the respective rails 120, 130, with the folded lid sides 162, 164 facing upward. However, it will be appreciated that the lid 106 may be inverted, and/or may be placed at angle such that only one edge of the lid 106 rests on one of the rails 124 or 134, and the opposing edge rests inside of the other rail 124 or 134. Reduced shipping cost is realized from requiring less room, as the lid 162 is disposed below the vertical level of the top of the side panels 110, 112. It will be appreciated that the tray 104 and the base 102 are shipped in substantially completed form. All of the fabric sheets 154, 156, 158 and 160 and the throws 200 are stowed under the collapsed lid 106. An optional pillow may also be included. Thus, the casket assembly 100 may be shipped occupying only the same space as the low-profile base 102.

Figure 10:
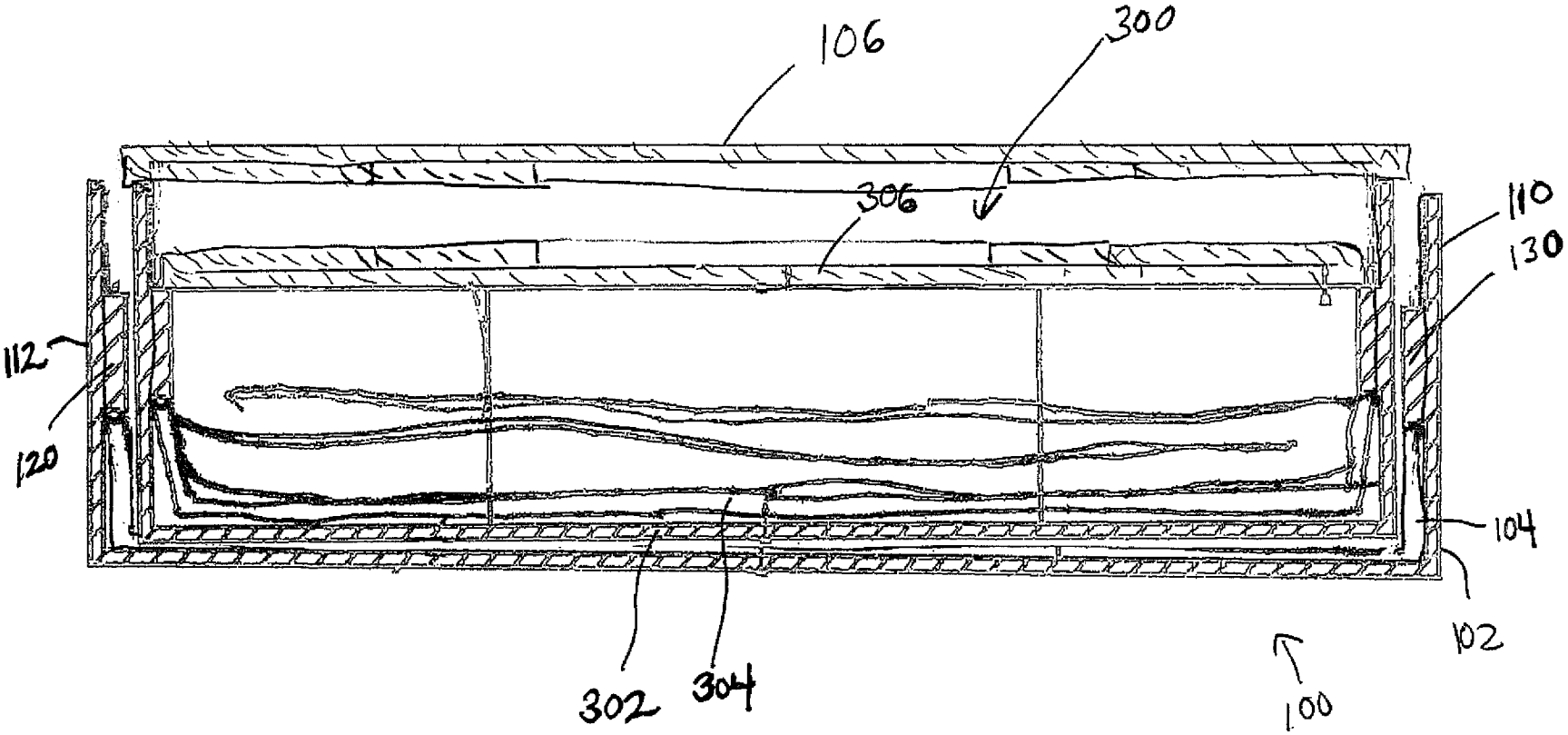
FIG. 10 shows a cutaway view of a second casket assembly nested into the casket assembly of FIG. 1 for shipment.

In another embodiment, another casket assembly having a similar structure may be nested with the casket assembly 100. To this end, the second casket assembly 300 has the same structure as the casket assembly 100, but is slightly smaller in length and width. FIG. 10 shows a cutaway view of a second casket assembly 300 nested into the casket assembly 100 for shipment. As shown in FIG. 10, the base 302 of the second casket assembly 300 is small enough to fit between the rails 120, 130. The second casket assembly 300 is nevertheless still sized to receive a supine deceased. The completed base 302 and tray 304 of the second casket is nested within the base 102 and tray 104 of the casket assembly 100. The lid 306 of the second casket assembly in unassembled (collapsed) form is placed in the second base 302, with the lid 106 of the (outer) casket assembly 100 is placed on the top of the base 302 of the second casket assembly 300. In this manner, the two casket assemblies 100, 300 can be shipped while occupying less space than a single, fully assembled casket assembly 100.

Referring again to the shipment of the single casket assembly 100, the casket assembly 100 may be unpacked at the destination (e.g. a funeral home) by removing the unassembled lid 106. (See FIG. 9). The lid 106 may be assembled for use. For use in a viewing of the deceased, the unattached sides of the throws 202, 204, 206 and 208 are lifted out interior 176, and then pulled down over their respective sides, as shown in FIGS. 6 and 7.

The throws 202, 204, 206 and 208 are then removably attached to the base 102 to hold the throws 202, 204, 206 and 208 in place, covering most or all of the corrugated paper of the base 102. To this end, the fasteners 182 on the wings 206*a*, 206*b*, 208*a*, 208*b* and the throws 202, 204 are coupled to the corresponding fasteners 180 on the side panels 110, 112 of the base. Specifically, the throws 206, 208 are draped over corresponding end panels 114, 116 and then the wings 206*a*, 206*b*, 208*a*, 208*b* are wrapped around the corners of the base 102 until the fasteners 182 on the wings 206*a*, 206*b*, 208*a*, 208*b* removably connect to the outermost fasteners 180 on the side panels 110, 112. Thereafter, the throws 202, 204 are draped over the corresponding side panels 112, 110 and the fasteners 182 of the throws 202, 204 are coupled to the remaining fasteners 180. As a result, the casket assembly 100 without the lid 106 appears as shown in FIG. 7. It will be appreciated that in other embodiments, the long throws 202, 204 may have the wings instead of the short throws 206, 208.

The free sides of the fabric sheets 154, 156 are also folded over their corresponding side panels 112, 110 and the free side of the fabric sheet 160 may be folded over the end panel 116. The deceased, not shown, may then be placed (with or without a pillow, not shown) on the liner 152 and the fabric sheet 158 under the head (and optional pillow). The fabric sheet 160 is placed over the feet of the deceased, and the fabric sheets 154, 156 folded back over the deceased to the degree desired. The deceased and the casket assembly 100, with the lid 106 removed, are ready for viewing.

After the viewing, the throws 202, 204, 206 and 208 may be disconnected from the side panels 110, 112, and placed within the interior 176 on the corresponding fabric sheets 154, 156, 158 and 160. The lid 106 may then be placed over the casket assembly 100 by placing the edges 172, 174 of the respective lid sides 162, 164 on the rails 130, 120. Handle openings 184 within the side panels 110, 112 may be used to carry or move the casket assembly 100 with the deceased in the interior 176. The liner 152 ensures that no contact with the deceased can occur via the handles openings 184.

The casket assembly 100 of FIG. 1 may also be employed as an insert to a rental casket, not shown. An example of a suitable rental casket is shown, by way of non-limiting example, in U.S. Pat. No. 8,607,423, which is incorporated herein by reference. In particular, it is known in the art to employ an ornamental rental casket in which a corrugated paper insert is used to support the deceased both within and without the rental casket.

Figure 11:
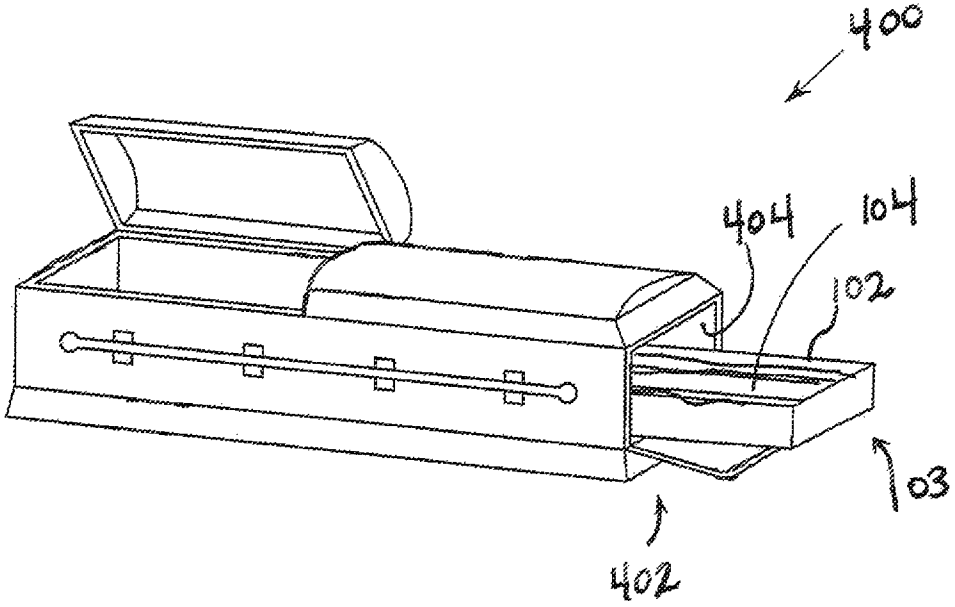
FIG. 11 shows a perspective view of the base and tray of the casket assembly of FIG. 1 implemented as a rental casket insert for use with an exemplary rental casket.

FIG. 11 shows a perspective view of the base 102 and tray 104 of the casket assembly 100 implemented as a rental casket insert 103 for use with an exemplary rental casket 400. As shown in FIG. 10, the rental casket 400 includes a foot-end hinged panel 402 which may be opened to allow insertion of the insert 103.

In a method of using the insert 103, the casket assembly 100 as shown in FIGS. 1-4 may be shipped in a partially unassembled state, similar to that discussed above in connection with FIG. 9. Specifically, the lid 106 may be collapsed into a flat structure, with the lid sides 162, 164 and the lid ends 166, 168 folded down over the lid top 170. As shown in FIG. 9, the collapsed lid 106, not shown, is placed within the space between the top surfaces 124, 134 of the rails 120, 130 and the top of the side panels 110, 112. The tray 104 and the base 102 are shipped in substantially completed form. All of the fabric sheets 154, 156, 158 and 160 are stowed under the collapsed lid 106. As discussed above, the casket assembly 100 may be shipped as part of a nested pair, as shown in FIG. 9.

As above, the casket assembly 100 may be unpacked at the destination (e.g. a funeral home) by removing the unassembled lid 106. The lid 106 may be assembled for later use, or left unassembled until necessary. For use in a viewing of the deceased, the free sides of the fabric sheets 154, 156 are also folded over their corresponding side panels 112, 110 and the free side of the fabric sheet 160 may be folded over the end panel 116. The deceased, not shown, may then be placed (with or without a pillow, not shown) on the liner 152 and the fabric sheet 158 under the head (and optional pillow). The fabric sheet 160 is placed over the feet of the deceased, and the fabric sheets 154, 156 folded back over the deceased to the degree desired. The deceased and the casket assembly 100, with the lid 106 removed, are ready for viewing.

The base 102 and tray 104 (collectively the insert 103) with the deceased may then be inserted into the rental casket 400 through the opening 404 defined by the open panel 402, as shown in FIG. 11. Throws from the rental casket 400, not shown in FIG. 11, may then be used to help cover the edges of the base 102. The panel 402 is closed, and the viewing may then occur.

After the viewing, the panel 402 is re-opened, and the insert 103 with the deceased is removed via the opening 404 in the foot end of the rental casket 400. Once removed, the lid 106 may then be placed over the casket assembly 100 by placing the edges 172, 174 of the respective lid sides 162, 164 on the rails 130, 120. Handle openings 184 within the side panels 110, 112 may be used to carry or move the casket assembly 100 with the deceased in the interior 176.

It will be appreciated that the above-described embodiments are merely exemplary, and that those of ordinary skill in the art may readily devise their own modifications and implementations that incorporate the principles of the preset invention and fall within the spirit and scope thereof. For example, it is possible in some embodiments to connect the long sheets 154, 156 to the rails 120, 130, or even to the side panels 110, 112 below the rails, instead of the tray.

What is claimed is:

1. A casket tray assembly, comprising:

a tray including a tray bottom, and first and second tray sides attached to the tray bottom, and first and second tray ends attached to the tray bottom, the tray having a length and a width sized and adapted to receive a human deceased in the supine position, a first fabric sheet having a first long edge and an opposite second long edge, the first fabric sheet operably secured to the tray proximate the first long edge of the first fabric sheet such that the first long edge of the first fabric sheet extends along and adjacent to the first tray side and the second long edge of the first fabric sheet is movable, the first fabric sheet sized to substantially cover the tray bottom; and a second fabric sheet having a first long edge and an opposite second long edge, the second fabric sheet operably secured to the tray proximate the first long edge of the second fabric sheet such that the first long edge of the second fabric sheet extends along and adjacent to the second tray side and the second long edge of the second fabric sheet is movable, the second fabric sheet sized to substantially cover the tray bottom.

2. The casket tray assembly of claim 1, wherein the first fabric sheet is secured to the first tray side, and the second fabric sheet is secured to the second tray side.

3. The casket tray assembly of claim 1, wherein the tray is configured to fit within and couple to a casket having first and second side panels, and first and second end panels, and wherein the first fabric sheet is secured to one of the first tray side or the first side panel, and the second fabric sheet is secured to one of the second tray side or the second end panel.

4. The casket tray assembly of claim 1, wherein the tray bottom, the first and second tray sides, and the first and second tray ends are formed from a single corrugated paper blank.

5. The casket tray assembly of claim 1, further comprising a liquid retaining liner disposed at least over the tray bottom.

6. The casket The tray assembly of claim 1, further comprising a third fabric sheet having an edge operably secured to the tray to extend along and adjacent to the first tray end.

7. The casket tray assembly of claim 6, wherein a fourth fabric sheet having an edge operably secured to the tray to extend along and adjacent to the second tray end.

8. The casket tray assembly of claim 6, further comprising a first fabric throw coupled adjacent to the first tray side, and a second fabric throw coupled adjacent to the second tray side.

9. The casket tray assembly of claim 8, wherein the first fabric throw includes a first removable fastener element configured to removably couple to a first mating removable fastener element, the first mating removable fastener element affixed at least indirectly to the tray.

10. The casket tray assembly of claim 1, wherein the first fabric sheet is operably secured to the tray using at least one fastener or adhesive disposed proximate to the first long edge of the first fabric sheet.

11. A casket assembly, comprising:

a base including a bottom panel, a first side panel, a second side panel, a first end panel and a second end panel, the base having a length and a width sized and adapted to receive a human deceased in the supine position, a first fabric sheet operably secured to the base such that the first fabric sheet extends along and adjacent to an inside surface of the first side panel and an edge of the first fabric sheet is movable, the first fabric sheet sized to substantially cover a width of the bottom panel;

a second fabric sheet operably secured to the base such that the second fabric sheet extends along and adjacent to an inside surface of the second side panel and an edge of the second fabric sheet is movable, the second fabric sheet sized to substantially cover the width of the bottom panel; and a third fabric sheet operably secured to the base such that the third fabric sheet extends along and adjacent to an inside surface of the first end panel and an edge of the third fabric sheet is movable, the third fabric sheet sized to substantially cover the width of the bottom panel.

12. The casket assembly of claim 11, wherein the first fabric sheet is sized at least to substantially cover a length of the bottom panel, and wherein the second fabric sheet is sized at least to substantially cover a length of the bottom panel.

13. The casket assembly of claim 11, wherein the first fabric sheet is secured to the first side panel, and the second fabric sheet is secured to the second side panel.

14. The casket assembly of claim 13, wherein the third fabric sheet is secured to the first end panel.

15. The casket assembly of claim 14, further comprising a first fabric throw coupled to the first side panel, and a second fabric throw coupled to the second side panel.

16. The casket assembly of claim 15, wherein the first fabric throw includes a first removable fastener element configured to removably couple to a first mating removable fastener element affixed to the base.

17. The casket assembly of claim 11, wherein the base includes first and second rails affixed to the side panels.

18. The casket assembly of claim 17, further comprising a removable lid covering an interior of the base, the lid including a lip top and lid sides, each lid side having a bottom edge, the lid having a collapsed configuration and a use configuration, wherein the lid in the collapsed configuration is disposed entirely below a vertical level defined by top edges of the side panels, and is supported at least in part the top surface of at least one of the first and second rails and, and wherein the lid in the use configuration extends at least in part above the vertical level defined by the top edges of the side panels, the bottom edges of the sides resting on the top surfaces of the first and second rails.

* * * * *